United States Patent [19]

Brass

[11] 4,079,945

[45] Mar. 21, 1978

[54] ROTATABLE BOARD GAME WITH MAGNETICALLY AFFECTED PLAYING PIECES

[76] Inventor: Robert L. Brass, 4 Norwood La., Westport, Conn. 06880

[21] Appl. No.: 755,146

[22] Filed: Dec. 29, 1976

[51] Int. Cl.[2] ..... A63F 3/00

[52] U.S. Cl. ..... 273/239; 46/237; 273/248; 273/280

[58] Field of Search .... 273/134 AE, 134 A, 134 GA, 273/134 G, 131 AD, 131 A, 130 A, 135 AD, 135 A, 136 B, 136 A, 137 AE, 137 A, 1 M, 137 AB, 86; 46/235, 237, 238, 239

[56] References Cited

U.S. PATENT DOCUMENTS

| | | | |
|---|---|---|---|
| 2,134,079 | 10/1938 | Fentress | 273/137 AB |
| 2,277,672 | 3/1942 | Stone | 46/237 |
| 2,295,452 | 9/1942 | Deaton | 273/134 AE |
| 2,795,427 | 6/1957 | Sachs | 46/238 |
| 3,374,573 | 3/1968 | Bishoff | 46/238 |
| 3,406,974 | 10/1968 | Nelson | 273/134 AE |
| 3,658,338 | 4/1972 | Wheelock | 273/134 AE |
| 3,762,714 | 10/1973 | Wilson | 273/134 GA |
| 4,013,291 | 3/1977 | Brass et al. | 273/130 A |

FOREIGN PATENT DOCUMENTS

| | | | |
|---|---|---|---|
| 821,205 | 8/1937 | France | 273/134 GA |
| 1,023,750 | 12/1952 | France | 46/237 |
| 7,770 of | 1896 | United Kingdom | 273/134 A |

*Primary Examiner*—Richard C. Pinkham
*Assistant Examiner*—Harry G. Strappello
*Attorney, Agent, or Firm*—Haynes N. Johnson

[57] ABSTRACT

A children's game is provided in which plastic animals, such as turtles, are used as playing pieces and race along the track of a game board, advancing a given number of spaces on the basis of the spinning of a dial. The game board, however, is round and rotatable and has a base with randomly positioned magnets under the spaces on the board. The playing pieces also include magnets which are affected when they are on spaces over the random magnets. In particular, the playing piece is designed so that the animal's head drops when over a magnet, so it "falls asleep." The animal can then be "awakened" by rotating the board the equivalent of one space and so removing it from the magnet. In doing so, however, another player's piece may be moved over a magnet and similarly "fall asleep".

11 Claims, 8 Drawing Figures

Fig. 1.
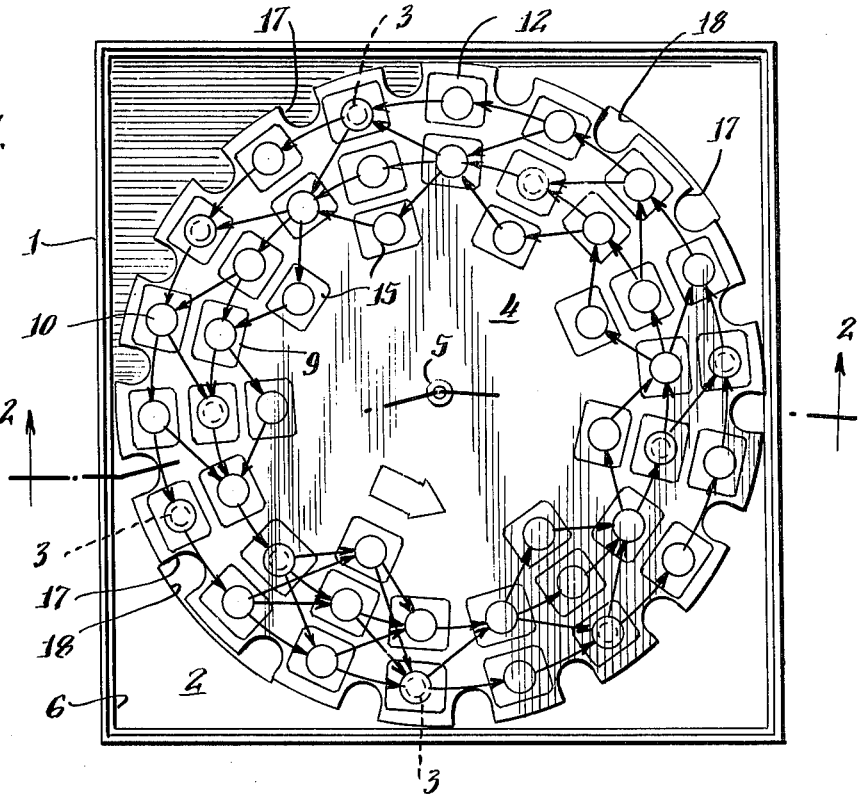
Fig. 2.
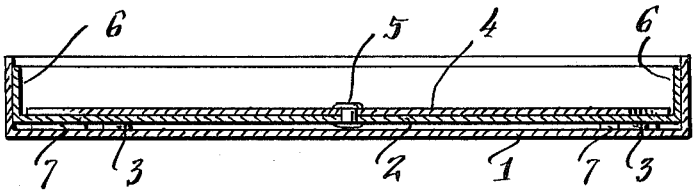
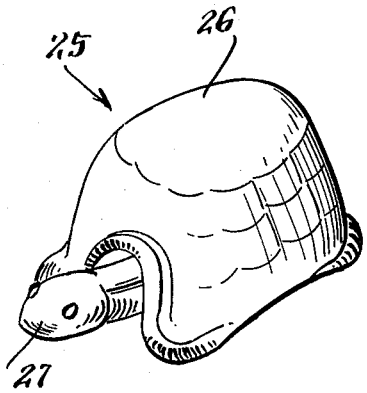
Fig. 4.
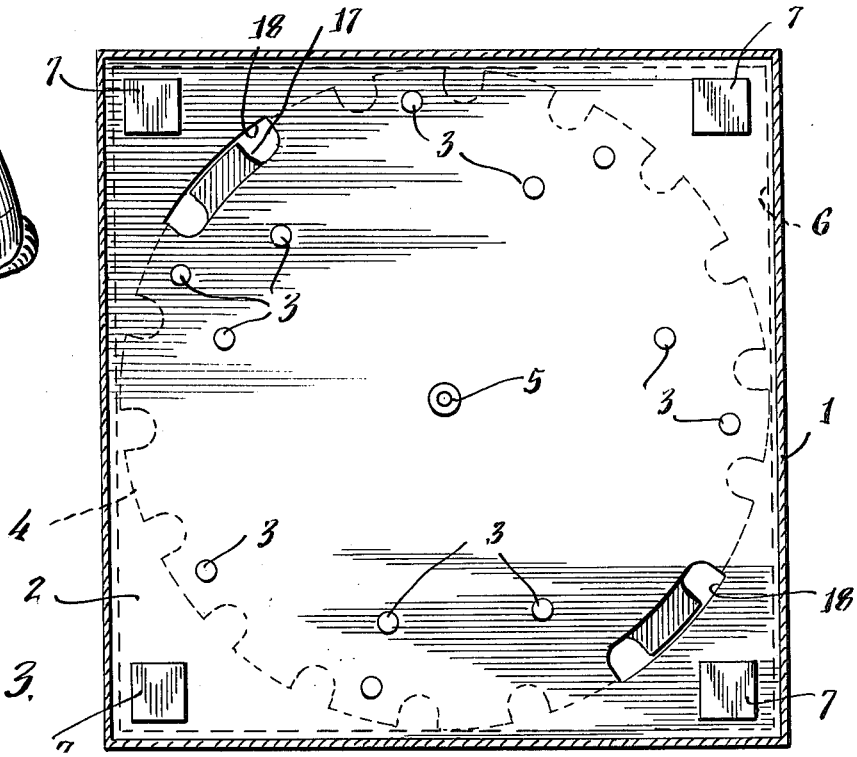
Fig. 3.

ROTATABLE BOARD GAME WITH MAGNETICALLY AFFECTED PLAYING PIECES

BACKGROUND OF THE INVENTION

Various games exist in which hidden magnets either affect playing pieces or are in some manner detected by playing pieces. In the former category are patents such as Nelson U.S. Pat. No. 3,406,974; and, in the latter, those such as Deaton U.S. Pat. No. 2,295,452, Potts U.S. Pat. No. 3,801,104 and applicant's pending application Ser. No. 634,608, filed Nov. 24, 1975, now U.S. Pat. No. 4,013,291.

These games, however, do not have the attribute of having the magnets in fixed position and the playing board mounted to be rotated during the game so as to change the relative position of the playing pieces and the hidden magnets; nor do they have a game board which itself is moved a distance equivalent to one space movement on the board.

SUMMARY OF THE INVENTION

This invention relates to the type of board game in which playing pieces are moved along a track on a game board a number of spaces determined by a rotating spinner. The various tracks for movement of the playing pieces are along concentric circles about a pivot upon which the game board rotates. The movement distances, per space, along the tracks are the same in terms of degrees of arc of a circle so that each movement is for a pre-determined distance (in terms of degrees).

Mounted underneath the board along the concentric circles are a series of magnets. These are randomly placed, in positions unknown to the players, except that each magnet is aligned with a space for the playing piece on the concentric track.

Means are provided for rotation of the game board by an amount just equal to the arcuate distance between and adjacent pair of spaces.

Playing pieces such as turtles or other animals are made to be magnetically responsive and so to act in some manner, such as "falling asleep", when they arrive at a space that is over one of the hidden magnets. In such instance the player looses the remainder of his turn and must use his next turn to rotate the game board the arcuate distance equal to one space so that his playing animal can "wake up". By so doing, however, he may rotate another playing piece over the same or another hidden magnet to cause that piece to "fall asleep", causing that player to loose his next turn.

Alternate routes may be provided for the playing pieces by which they are removed from the concentric circles and therefore, not subject to magnetic action.

DESCRIPTION OF THE FIGURES

FIG. 1 is a top plan view looking down at the game board from above;

FIG. 2 is a section taken on lines 2—2 of FIG. 1 through the game board showing the pivoted rotatable board and some magnets positioned underneath it;

FIG. 3 is a view of the underside of the game with the bottom portion of the outer box removed so that one can see the structure;

FIG. 4 is a perspective view of a typical playing piece, in this instance a turtle with a head that can be raised and lowered as the turtle is "awake" or "asleep";

DETAILED DESCRIPTION OF THE INVENTION

The Nature of the Game

Figure 5:
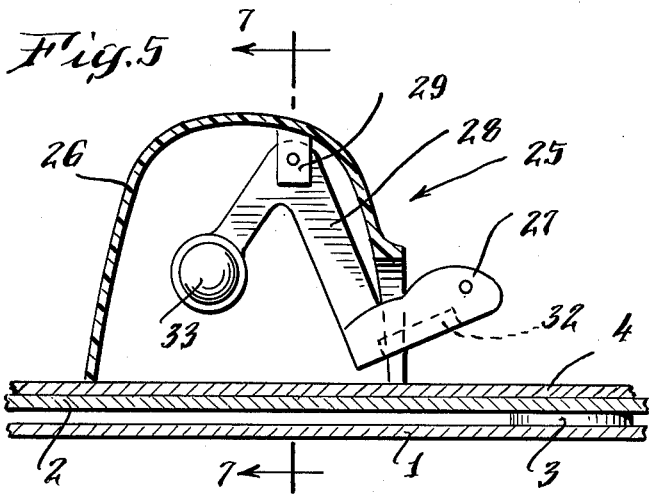
FIG. 5 is a sectional view showing the inside of the turtle with the turtle in the "awake" position.
Figure 7:
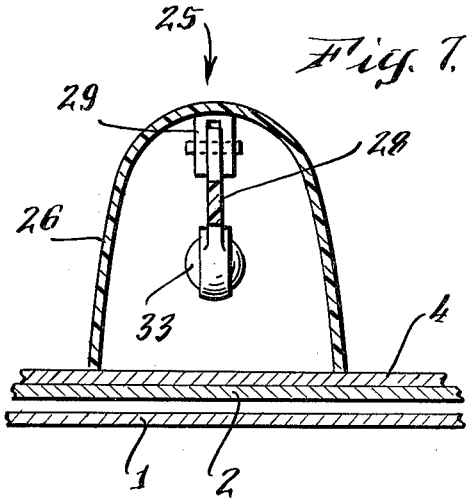
FIG. 7 is a section transversely across the turtle on the line 7—7 of FIG. 5.
Figure 6:
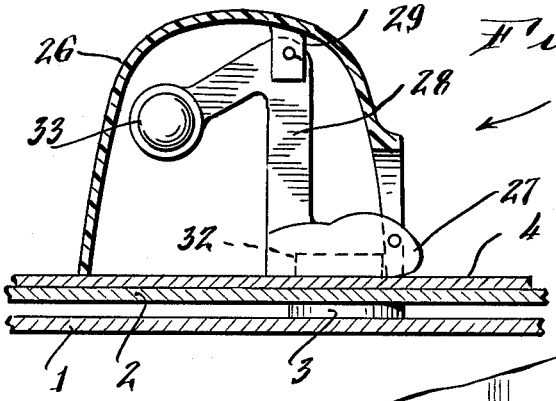
FIG. 6 is the same view with the turtle "asleep"

The game of my invention is a variation on the board game in which playing pieces move along a track or tracks a specified number of spaces as determined by a spinner (not shown). Here the tracks are two concentric circles on a circular game board that is mounted to be rotated about its center.

The playing pieces are plastic turtles with heads pivotally mounted on an arm within the turtle's shell, so that the heads may be out of the shell and slightly raised when the turtle is "awake" and lowered and retracted into the shell when the turtle is "asleep".

A series of magnets fixed in position on a board below the circular playing board underneath the track attract magnets in the turtles' heads when the playing pieces happen to be over one of the magnets. The magnets pull the head down to cause the turtle to fall asleep.

Normally, one circuit of the track constitutes a game, and the player finishing first is the winner.

The Game Board

The game board is shown in FIGS. 1 and 2 and, preferably, is permanently mounted within the lower half of the box in which the game is sold. It includes the outer shell 1 of the lower half of the box, inner board 2 which carries the hidden magnets 3, and the circular rotating game board 4 secured to inner board 2 at its center by pivot 5.

Board 4 has two tracks printed on it. These are concentric circles centered on pivot 5 and designated inner track 9 and outer track 10. Each of these tracks includes an equal number of spaces for movement of the pieces. Inner track 9 has 18 spaces 11, and outer track 10 has 18 spaces 12. The spaces in each track are spaced equidistantly from one another in terms of degrees of arc, and so, in the example selected using eighteen spaces in each track, these spaces are 20° of arc removed from one another. Other numbers could be used as long as they are equally spaced arcuately.

Inside tracks 9 and 10 there are occasional safe spaces 15 which are never over magnets 3.

As shown by the arrows in FIG. 1, the playing pieces can be moved from space to space along either one of the tracks 9 or 10, may be moved between the tracks, or may be moved to and from the safety spaces 15.

Between each of the spaces 12 on outer track 10 and along the circumference of inner board 2 are finger notches 17. Since the notches are between each of these spaces 12, the notches are the same angular distance apart as are the spaces 11 and 12 (in the particular instance shown, 20° of arc).

Positioned under the finger notches 17 in diagonally opposite corners of inner board 2 are two arcuate slots 18. They are of a length such that when a player puts his finger in a particular finger notch 17 positioned over the arcuate slot 18 and moves it the length of the slot, he will rotate board 4 exactly one position, i.e. 20° . This rotation normally is in the direction of the arrows, i.e. counterclockwise in the drawing of FIG. 1. Thus rotating board 2 by use of finger notch 17 in arcuate slot 18 will rotate the board 20° , i.e., the equivalent of one space.

A series of small round magnets are glued to the underside of inner board 2. They are positioned such that they will be under, not between, some of the spaces 11 and 12 when the circular board 4 is rotated the fixed amounts as governed by the movement in finger notches 17 in arcuate slot 18. Being under tracks 9 and 10, the magnets will not be under any of the safety spaces 15.

The number of magnets used is a matter of design and, in my preferred embodiment, I have used six magnets under each of tracks 9 and 10. They are glued to the underside of board 2 in random positions so the player can not tell where the magnets are. By random I mean they are placed so they will be under the spaces of tracks 9 and 10, but spaced apart one or more of the arcuate spacing distances between spaces 11 and 12 when the board 4 is rotated as above described. Thus, there might be magnets under two adjacent spaces 12 in track 10 and then the next magnet might be three spaces away under track 10. The objective is to have the magnets under certain of the spaces 11 and 12 (not between them). This introduces an element of chance for the player because he does not know the particular spaces the magnets are under at any given rotative position of board 4.

After circular, rotating game board 4 is pivotally secured to inner board 2, inner board 2 is preferably glued to the inside of the outer shell 1. This can be done, if desired, by having the the edges of board 2 include flanges 6 directed upwardly and gluing the flanges to the inner sides of shell 1. If desired, there may be spacers 7 in the corners of inner board 2 and between that board and the outer shell, the same thickness as magnets 3, simply to give board 2 a flatter surface.

THE PLAYING PIECES

The playing pieces are shown in FIGS. 4 through 7. Each is in the form of a turtle 25 having a shell 26 and a movable head 27 projecting forwardly out of the shell. The head is mounted on an arm 28 pivoted to the inside of the shell at pivot 29.

The head includes a magnet 32 on its underside. The head is counterbalanced by weight 33 on the opposite end of arm 28 from the head. The relative weights of head 27, arm 28, magnet 32, and counterbalancing weight 33, relative to the respective lengths of the portions of arm 28, are such that normally the head will be elevated above circular board 4, but such that if head 27 is over one of the hidden magnets 3, the attraction between magnets 3 and 32 will draw the head down to the upper surface of circular game board 4. This also tends to draw the head inside the shell.

Thus, when head 27 is not above a magnet 3, it is elevated and protrudes from shell 26; and the turtle is "awake". When the head 27 is above one of the magnets 3, it will be down on the board and somewhat inside shell 26; and the turtle will be "asleep".

Figure 8:
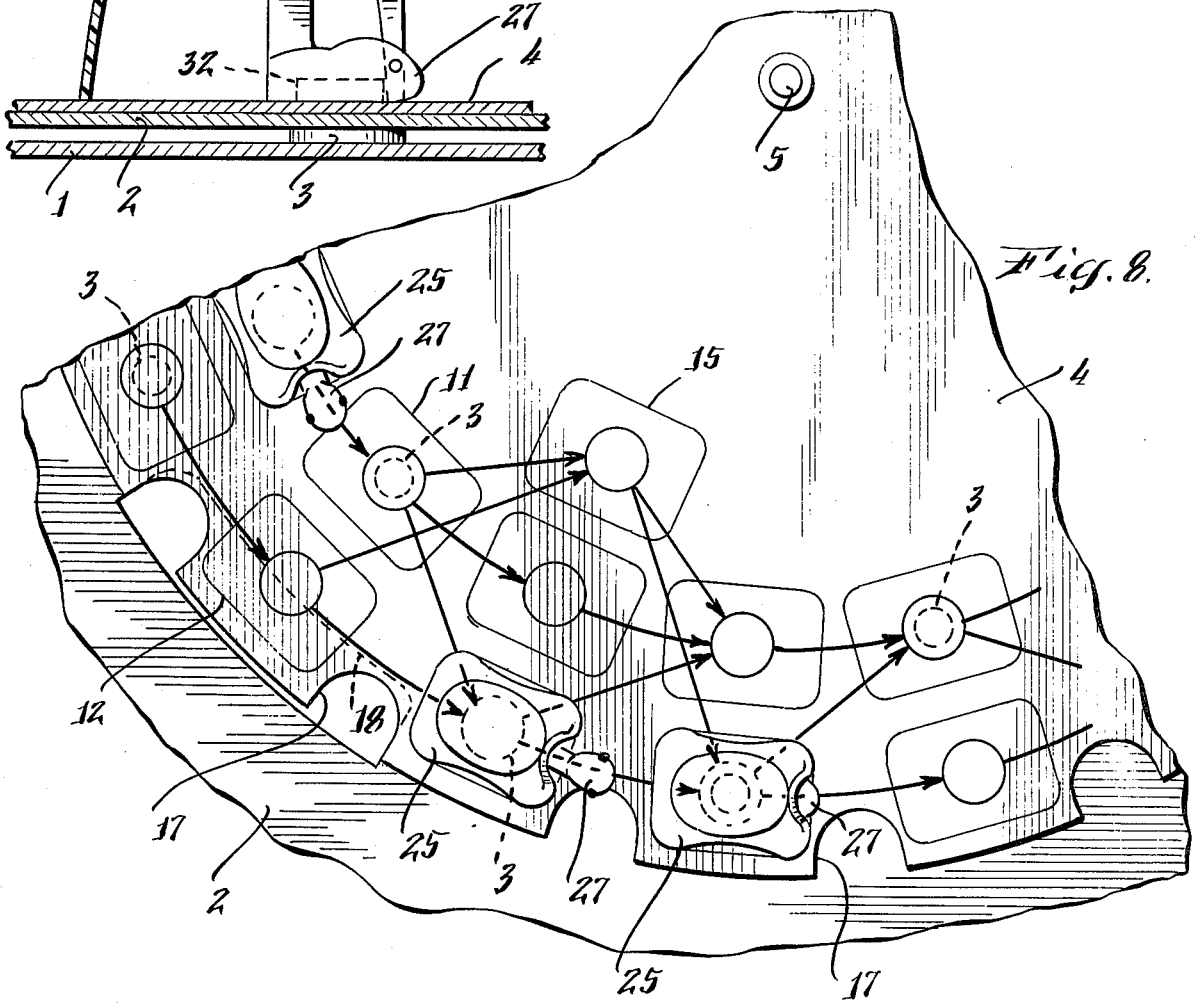
FIG. 8 is a planed view of a portion of the game board showing the paths that can be taken by the turtle during the game and, in dotted lines, the location of the hidden magnets.

FIG. 8 shows a portion of the game board with several turtles on it. It will be noted that those turtles in spaces over magnets 3 have their heads withdrawn and are "asleep". Those not over magnets have their heads extended and are "awake".

PLAYING

The game resembles the usual kind of race game for children in which playing pieces are moved along spaces in a track from a start position to a finish position a number of spaces equivalent to the number shown on the usual spinner, by the roll of a die, or in some other manner. The game, however, has a variation in that the pieces can be put out of action, and the player loose any further steps along the track and/or loose a turn, if the piece comes over a magnet.

In the form shown the playing piece is a turtle with a movable head which is either awake or asleep.

As a player moves his turtle along a track the requisite number of spaces, he will advance his piece toward the finish line. However, if, in moving it, he should move it over a magnet, then the turtle will fall asleep and the player is not allowed to move his piece further. In addition, the player's next turn must be used to rotate circular board 3 the equivalent of one space by inserting his finger in finger notch 17 and rotating the board by moving his finger the length of arcuate slot 18. By so doing, his turtle will be moved from the space over the magnet (since the magnet is attached not to the rotating board 4 but to the inner board 2) to a space not over a magnet. The turtle will then awaken, and at the player's next turn, he can again proceed to move the turtle.

Rotation of circular board 4 can also have another effect in that the turtle of another player may, by that same rotation, be moved over a magnet 3. If so, the opponent's turtle will fall asleep, and he will, accordingly, loose a turn and have to rotate the board at his next turn.

Players may move their turtles from the spaces 11 on inner track 9 to spaces 12 on outer track 10 and vice versa if they wish to do so, hoping to avoid one of the hidden magnets 3. A variation on the game is provided if desired by having occasional safety spaces 15. When those are available and the arrows so indicate, the player may move his turtle through the space 15 with the assurance that there will be no magnet 3 under space 15 and so he can avoid the possibility of loosing a turn by having his piece fall asleep.

I claim:

1. A board game including a base, a rotatable board pivotally supported upon said base, said board including at least one circular track thereon centered about said pivot, said track including equidistant stopping positions thereon, said base including a plurality of magnets thereon mounted beneath said rotatable board and beneath said circular track said magnets being positioned from one another in multiples of the spacing of said equidistant stopping positions, magnetically-sensitive playing pieces for movement from one stopping position to another along said track, said playing pieces having means thereon to indicate when they are in positions above one of said magnets, and means to rotate said board about said pivot by a distance equal to the distance between said stopping positions whereby as said playing pieces are moved from position to position along said track, they are periodically affected by said magnets and so indicate.

2. A board game as in claim 1 wherein said means to rotate said board includes finger holes on the periphery of said rotatable board in line with a slot in said base, said slot being of a length so that movement of said finger openings the length of said slot will rotate said board a distance equal to the spacing between an adjacent pair of stopping positions.

3. A board game as in claim 1 in which said magnets are mounted on said base at random positions under said equidistant stopping positions.

4. A board game as claimed in claim 1 in which there are at least two concentric circular tracks on said board, each of said tracks having the same number of equidistant stopping positions thereon and in which said magnets are positioned under some of said stopping positions in each of said tracks.

5. A board game as claimed in claim 4 in which there are additional stopping positions adjacent one of said tracks, said latter named stopping positions not being in either said circular track and thereby not being above any of said magnets.

6. A board game as claimed in claim 1 in which said playing pieces are in the form of animals having pivoted and counterbalanced heads thereon, said counterbalancing being such that the animal's head is at an upper position when said piece is not above one of said magnets but is magnetically attracted downwardly when said piece is positioned in a stopping position above one of said magnets.

7. A board game as claimed in claim 6 in which the head of said animal includes a magnet.

8. A board game usable for racing playing pieces along spaces on tracks for distances determined by a chance means and including means for interrupting movement of said pieces by chance, including a base, a circular, rotatable game board pivotally mounted on said base, said board including a plurality of concentric circular racing tracks centered on said pivotal mounting, said tracks having an equal number of playing spaces thereon, said spaces in each said track being separated from one another by an equal arcuate distance, means for rotating said board an amount equal to said arcuate distance hidden magnets on said base under said tracks, and playing pieces for racing on said tracks having indicating means thereon to show when they are above one of said hidden magnets.

9. A board game as in claim 8 in which said magnets are spaced apart by distances which are multiples of said arcuate distance and so placed as to be under said playing spaces.

10. A board game as in claim 8 in which said means for rotating said board include finger notches on said board and slot therebeneath in said base.

11. A board game as in claim 8 in which said playing pieces are in the form of animals and said indicating means is motion of the animal's head occurring when said animal is positioned above one of said magnets whereby said animal appears to fall asleep.

* * * * *